US008611502B1

(12) United States Patent
Adams et al.

(10) Patent No.: US 8,611,502 B1
(45) Date of Patent: Dec. 17, 2013

(54) CONTINUOUSLY VARIABLE FOCAL LENGTH LENS

(75) Inventors: Bernhard W. Adams, Naperville, IL (US); Matthieu C. Chollet, Oak Park, IL (US)

(73) Assignee: U.S. Department of Energy, Washington, DC (US)

( * ) Notice: Subject to any disclaimer, the term of this patent is extended or adjusted under 35 U.S.C. 154(b) by 354 days.

(21) Appl. No.: 12/910,013

(22) Filed: Oct. 22, 2010

(51) Int. Cl.
*G21K 1/00* (2006.01)

(52) U.S. Cl.
USPC ..... 378/145; 378/146; 359/665; 359/666; 359/667; 359/668

(58) Field of Classification Search
USPC ..... 378/84, 85
See application file for complete search history.

(56) References Cited

U.S. PATENT DOCUMENTS 6,718,009 B1 * 4/2004 Khounsary ..... 378/84

* cited by examiner

*Primary Examiner* — Hoon Song
*Assistant Examiner* — Danielle Fox
(74) *Attorney, Agent, or Firm* — Jacob Heafner; Brian J. Lally; John T. Lucas

(57) ABSTRACT

A material preferably in crystal form having a low atomic number such as beryllium (Z=4) provides for the focusing of x-rays in a continuously variable manner. The material is provided with plural spaced curvilinear, optically matched slots and/or recesses through which an x-ray beam is directed. The focal length of the material may be decreased or increased by increasing or decreasing, respectively, the number of slots (or recesses) through which the x-ray beam is directed, while fine tuning of the focal length is accomplished by rotation of the material so as to change the path length of the x-ray beam through the aligned cylindrical slots. X-ray analysis of a fixed point in a solid material may be performed by scanning the energy of the x-ray beam while rotating the material to maintain the beam's focal point at a fixed point in the specimen undergoing analysis.

13 Claims, 6 Drawing Sheets

Fig. 2

Fig. 7
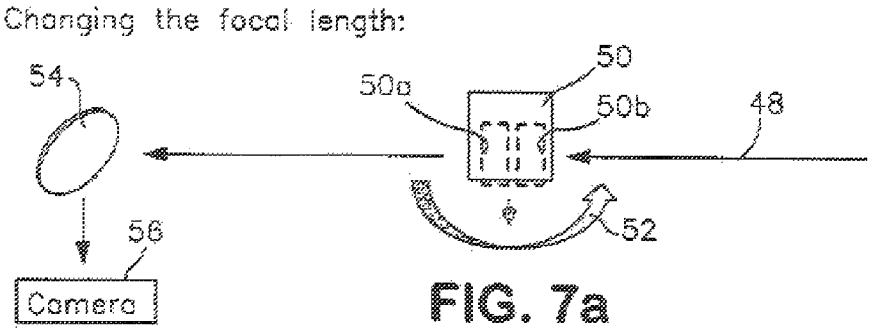
FIG. 7a
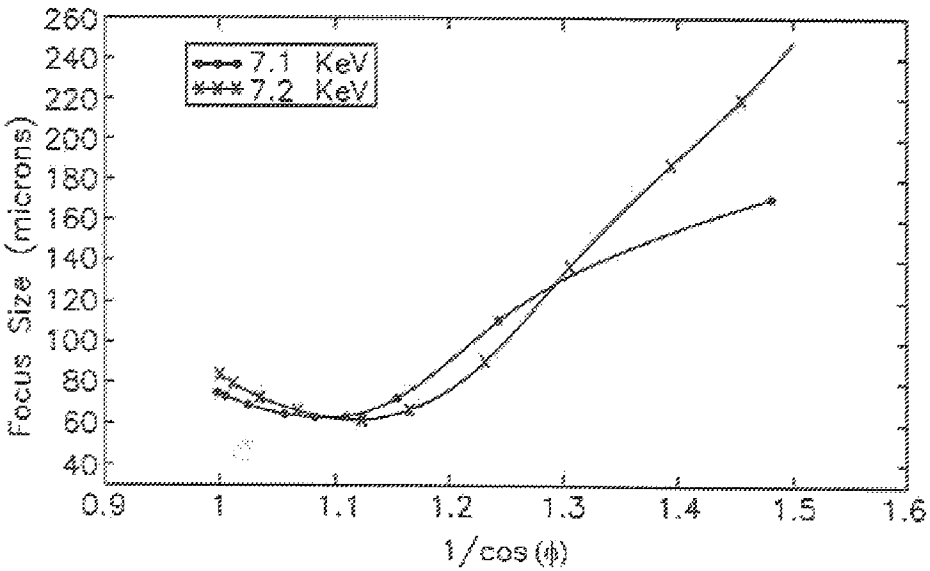
FIG. 7b

CONTINUOUSLY VARIABLE FOCAL LENGTH LENS

The United States Government has rights in this invention pursuant to Contract No. DE-ACO2-06CH11357 with the U.S. Department of Energy.

FIELD OF THE INVENTION

This invention relates generally to the study and analysis of materials using x-rays and is particularly directed to a refractive lens for use with x-rays having a continuously variable and selectable focal length, as well as being capable of continuously compensating for wavelength dispersion of the x-rays.

BACKGROUND OF THE INVENTION

Refractive x-ray lenses have been in use for many years in a wide range of scientific and industrial applications. The focal length of a refractive x-ray lens is determined by its index of refraction, the radius of curvature of the front surface of the lens, and the radius of curvature of the rear surface of the lens.

An x-ray lens is comprised of a block of material typically having a low atomic number (Z), such as beryllium, and may be, but does not necessarily have to be, in crystal form with slots, or holes, drilled into the block of material. The focal length of the beryllium lens is directly proportional to the radius of the slot and is inversely proportional to the square of the x-ray wavelength and to the number of slots formed in the beryllium material. A single slot typically provides the beryllium lens with a focal length on the order of tens of meters. One can incrementally tune, or vary, the focal length of the beryllium lens by varying the number (N) of slots the x-ray beam passes through, i.e., the more slots through which the x-ray beam is transmitted, the shorter the focal length of the lens. At long distances it is impractical to adjust the focal length in this way because the relative focal length changes are small, while the relative difference between N and N+1 is large so the adjustment would be very coarse. In addition, while the slots in the lens material are primarily disclosed as being cylindrical in shape, they do not have to be cylindrical. Any empty space, or void, in the lens material having spaced, facing, curvilinear surfaces through which the x-rays are directed would act as a lens and would be the continuously variable by the present invention.

In many applications involving the use of x-ray lenses, it is desirable to direct an x-ray beam onto a material and vary the photon energy of the beam which is reciprocal to the wavelength over a range of energies in studying the changes in structure and characteristics of the material. Changing the photon energy of the x-rays passing through an x-ray lens results in a change in the position at which the beam is focused by the lens which is undesirable. As a practical matter, it is difficult, if not impossible, to change the number of slots through which the beam passes within the same lens to compensate for changes in the focal length of the lens arising from changes in the x-ray beam's energy.

The present invention addresses this and other problems encountered in the prior art by providing a continuously variable focal length lens for focusing an x-ray beam over a range of focal lengths. This is achieved inexpensively and in a compact manner by the present invention.

OBJECTS AND SUMMARY OF THE INVENTION

Accordingly, it is an object of the present invention to provide an x-ray lens having a continuously variable focal length.

It is another object of the present invention to provide a compact arrangement for precisely focusing an x-ray beam at a fixed point while scanning the x-ray photon energy over a wide range of energies.

Yet another object of the present invention is to provide for coarse and fine adjustment of the focal length of an x-ray beam for short as well as long focal lengths.

A still further object of the present invention is to provide a scaling factor for lenses other than cylindrical, such as parabolic lenses, which does not have the problems of spherical aberration.

The present invention contemplates an apparatus and a method for providing a continuously variable focal length for an x-ray beam comprising: providing a low atomic number material having plural optically matched curvilinear surfaces in common alignment and disposed in a spaced manner in said material; directing an x-ray beam onto the material and through the plural curvilinear surfaces for focusing the x-ray beam at a focal point; and rotating said material about an axis generally perpendicular to the x-ray beam and to the plural curvilinear aligned surfaces for changing the location of the focal point of the x-ray beam in a continuous manner, or maintaining the focal length during a photon energy scan.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 7*a* is a simplified schematic diagram of the manner in which the focal length of an x-ray beam is changed by rotating a lens element in accordance with the present invention;

FIG. 7*b* is a graphic representation of the variation of the focus size of an image using a scaling factor at two different incident x-ray beam energies in accordance with another aspect of the present invention.

DETAILED DESCRIPTION OF THE PREFERRED EMBODIMENTS

Figure 1:
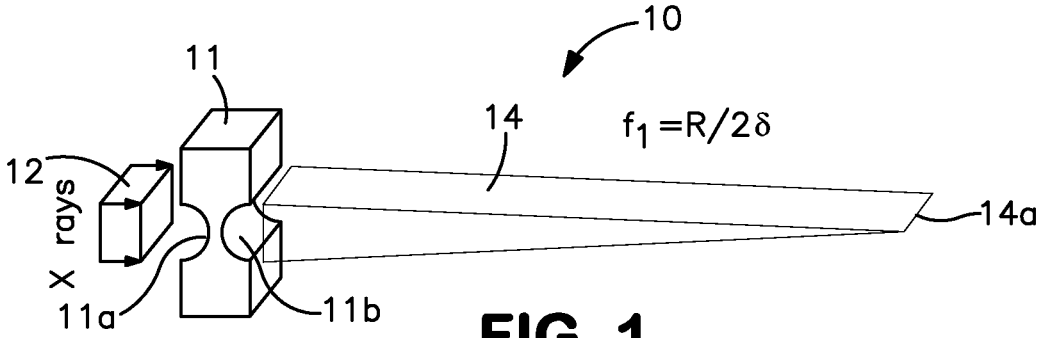
FIG. 1 is a simplified schematic diagram of a refractive lens for focusing x-rays in accordance with one embodiment of the present invention.

Referring to FIG. 1, there is shown a simplified schematic diagram of an x-ray lens 10 in accordance with one embodiment of the present invention invention. In the following discussion, the beryllium material 11 is described and illustrated as being in the general shape of a block, but the beryllium material is not limited to this shape and may assume virtually any shape and still provide the continuously variable focal length lens of the present invention. Lens 10 includes a beryllium material 11 having first and second concave recesses 11*a* and 11*b* in opposed outer surfaces of the material. Lithium as well as other elements having a low atomic number could also be used for the lens material. The use of a single crystal would eliminate various sources of scattering errors such as internal and surface imperfections. Each of the first and second concave recesses 11*a*, 11*b* is curvilinear in shape, with the two concave recesses aligned with one another. An x-ray beam 12, shown generally rectangular in cross section, is directed onto a first surface of the beryllium material 11 at the location of the first concave recess 11*a*. The x-ray beam may be continuous or pulsed as directed on a specimen being studied. The x-ray beam 12 is transmitted through the beryllium material 11 and exits at the location of the second concave recess 11*b*. The refractive characteristics of the beryllium material 11 and the shape of the first and second concave recesses 11*a*, 11*b* cause the x-ray beam 14 to converge along a focal line 14*a*, as the beam is focused in only one direction, i.e., vertical. It is not the particular shape of the slots within the beryllium material 11 which is important. What is important is the presence of the interface of the beryllium material with space which causes diffraction of the x-ray beam and a change in its focal distance. It is also important that each pair of curvilinear surfaces formed within or on the surface of the beryllium material 11 are concave and are matched, or have essentially the same radius of curvature to eliminate the effects of astigmatism.

Figure 2:
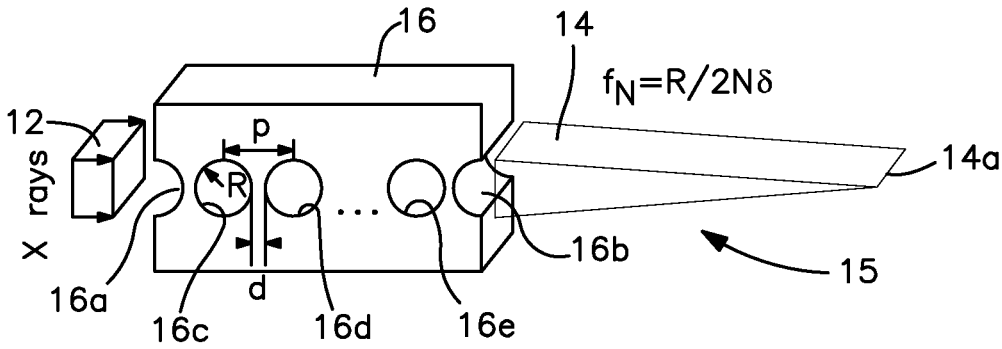
FIG. 2 is a simplified schematic diagram of another embodiment of a refractive lens for focusing x-rays in accordance with the present invention.

Referring to FIG. 2, there is shown a simplified schematic diagram of a x-ray lens 15 in accordance with another embodiment of the present invention. In FIGS. 1 and 2, the same element numbers are used to identify the same elements which are illustrated in both figures. Continuously variable focal length lens 15 also includes a beryllium material 16 having first and second concave recesses 16*a* and 16*b* disposed in opposed outer surfaces of the material. The beryllium material 16 further includes plural spaced cylindrically shaped slots, or holes, 16*c*, 16*d* and 16*e*, arranged in a spaced manner and disposed in an aligned array between the first and second concave recesses 16*a*, 16*b*. An x-ray beam 12 shown having a generally rectangular cross section 12 is incident upon a surface of the beryllium material 16 at the location of the first concave recess 16*a* therein. The x-ray beam 12 is transmitted through the beryllium material 16 and sequentially passes through the first concave recess 16*a*, the first, second and third cylindrical slots 16*c*, 16*d* and 16*e*, and then through the second concave recess 16*b*. The refractive characteristics of the beryllium material 16 and the shape of the surfaces formed on and within the beryllium material by the first and second concave recesses 16*a*, 16*b* and the first, second, and third cylindrical slots 16*c*, 16*d* and 16*e* focus the x-ray beam, with the focused x-ray beam 14 forming a generally straight line at the beryllium material's focal point 14*a*. Again, the focused x-ray beam 14 is shown in the form of a straight line because the x-ray beam is focused in only one direction. In the figures, each of the recesses and cylindrical slots is provided with a radius R, while the distance between the center of adjacent cylindrical slots is shown as P and the distance between the closest portions of adjacent cylindrical slots is given by d.

The focal length $f_1$ of the continuously variable focal length lens 10 shown in FIG. 1 is given by Equation 1.

$$f_1 = \frac{R}{2\delta} \qquad \text{Equation 1}$$

From Equation 1, it can be seen that the focal length of the continuously variable focal length lens 10 of FIG. 1 is directly proportional to the radius R of the first and second concave recesses 11*a*, 11*b* within the beryllium material 11. In addition, the focal length of the lens is inversely proportional to the refractive index decrement 6 of the beryllium material 11.

The complex refractive index n of the lens material of the continuously variable focal length lens 10 is determined by Equation 2.

$$n=1-\delta+i\beta \qquad \text{Equation 2}$$

where δ is the refractive index decrement of the material, i is the imaginary unit, and β is the imaginary part of the material's refractive index, which causes absorption.

The refractive index decrement δ is given by Equation 3.

$$\delta \cong Z(r_0\lambda^2 N_a/2\pi A)\rho \qquad \text{Equation 3}$$

where Z is the atomic number of the lens material, $r_0$ is the atomic radius of the material, λ is the wavelength of the x-ray beam, $N_a$ is Avogadro's number, A is the atomic weight of the lens material, and ρ is the mass density of the lens material.

The focal length $F_N$ of the continuously variable focal length lens 15 shown in FIG. 2 is given by Equation 4.

$$F_N = \frac{R}{2N\delta} \qquad \text{Equation 4}$$

where R is the radius of the concave recesses 16*a*, 16*b* as well as of the cylindrical slots 16*c*, 16*d* and 16*e* in the beryllium material 16 and N is the number of holes, while δ is the refractive index of the beryllium material.

Figure 3:
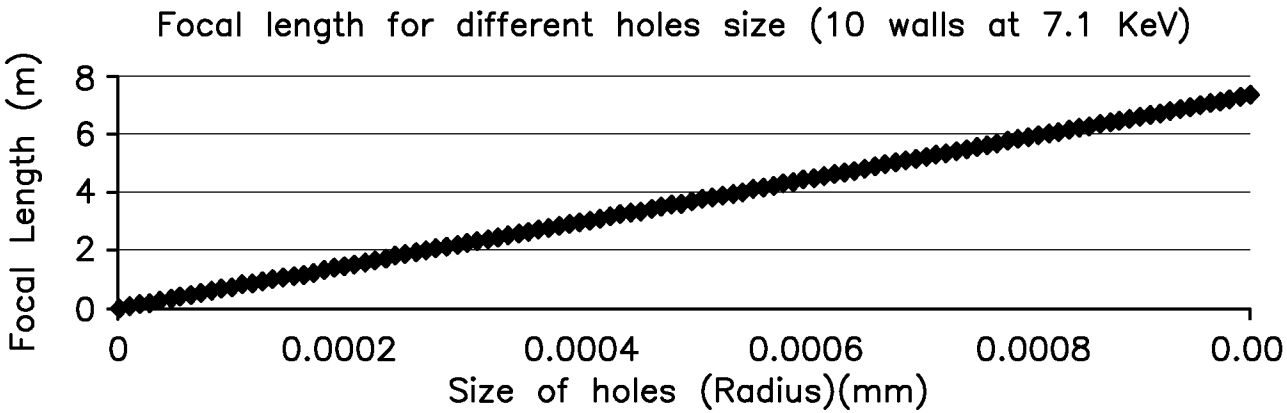
FIG. 3 is a graphic representation of the variation of focal length with different slot sizes in the lens of the present invention.

Referring to FIG. 3, there is graphically shown the change in focal length in meters with a change in the size of the slots, or holes, i.e., in the case of cylindrical slots, the radius of the slot in millimeters. Thus, an increase in the size of the diameter of the cylindrical slots from approximately 0.2 to 0.8 millimeters results in an approximate increase in the focal length of the lens from 1.3 meters to 6 meters.

Figure 4:
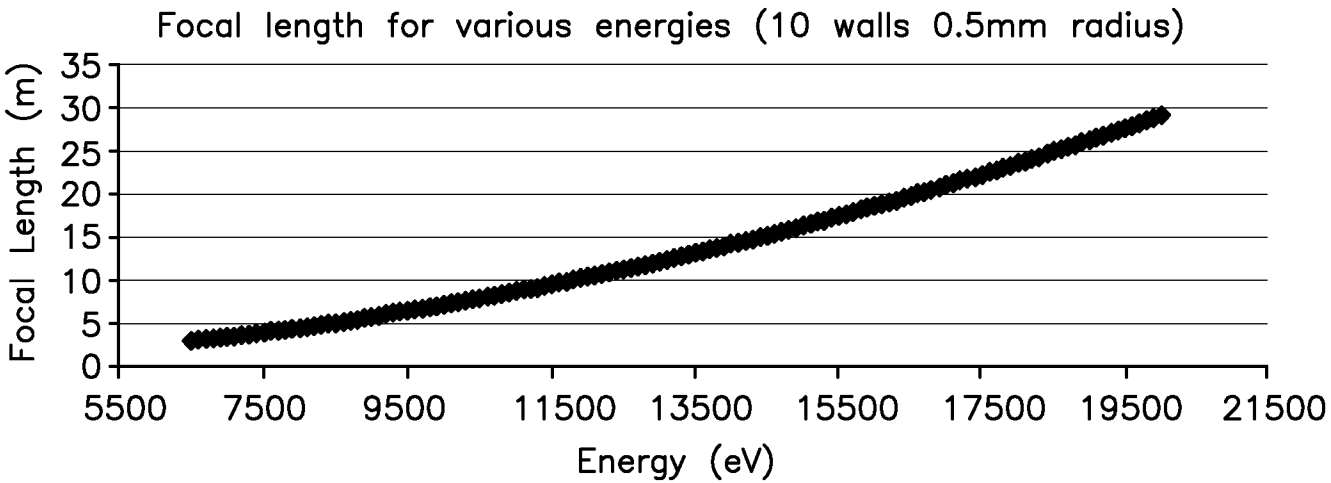
FIG. 4 is a graphic representation of the variation of focal length over a range of energies of the incident x-rays in the lens of the present invention.

Referring to FIG. 4, there is shown a graphic representation of the change in focal length of a continuously variable focal length lens in accordance with the present invention with a change in the energy of the incident x-rays. As illustrated, an increase in the energy of the incident x-ray beam from approximately 7,500 to 19,500 electron volts results in an increase in the focal length of a continuously variable focal length lens in accordance with the present invention from approximately 4.5 meters to 27 meters. The x-ray beam is typically scanned in energy in x-ray absorption spectroscopy.

Figure 5:
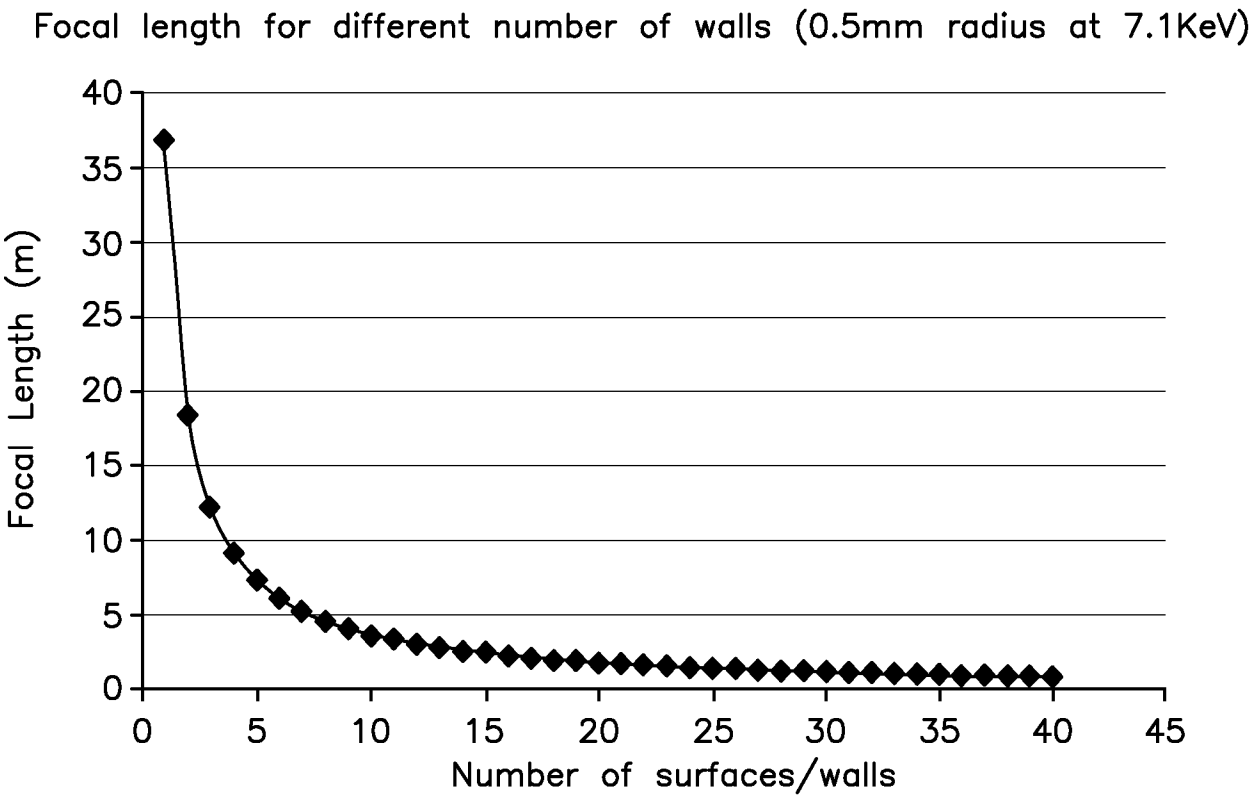
FIG. 5 is a graphic representation of the change in focal length as a function of the number of walls, or surfaces, through which the x-ray beam is passed within the continuously variable focal length lens of the present invention.

Referring to FIG. 5, there is shown the variation of focal length in meters with a change in the number of surfaces, or walls, in a continuously variable focal length lens in accordance with the present invention. From the graph of FIG. 5, it can be seen that by increasing the number of surfaces, or walls, within or on the beryllium material will result in a reduction in the focal length of the continuously variable focal length lens. For example, an increase in the number of surfaces within or on the beryllium material from approximately 2 to 25 will result in a reduction of the focal length of the continuously variable focal length lens from approximately 20 meters to 1 meter. The results shown in FIGS. 3, 4 and 5 are for a case of cylindrical slots in or cylindrical recesses on the beryllium material, where an x-ray beam of 7.1 KeV is incident upon the beryllium material.

Figure 6A:
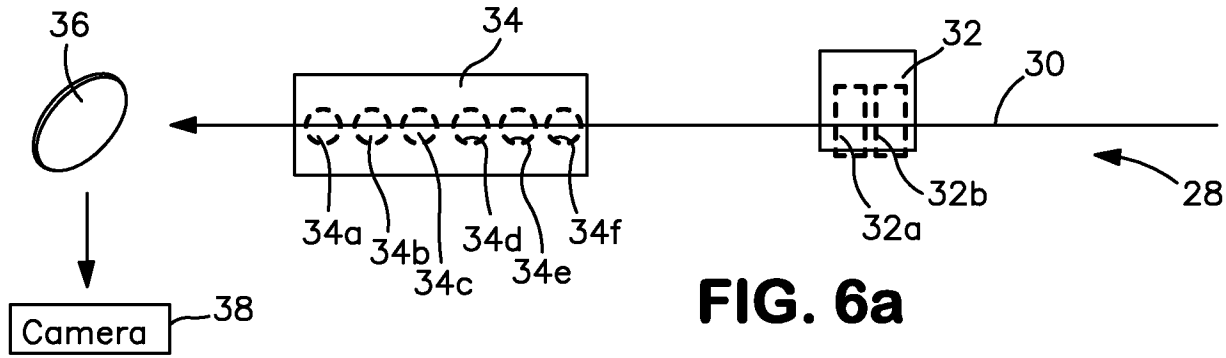
FIG. 6*a* is a simplified schematic diagram of one embodiment of a compound refractive lens in accordance with the present invention.
Figure 6D:
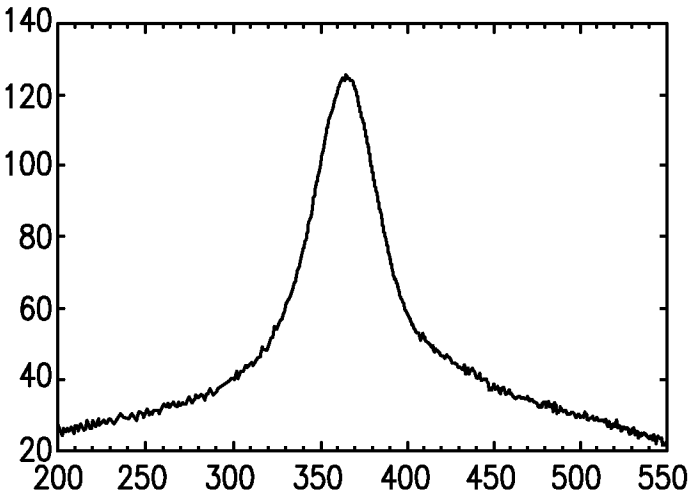
FIG. 6*d* is a graphic representation of the spatial distribution of the x-ray beam illustrated in FIGS. 6*b* and 6*c;*
Figure 6B:
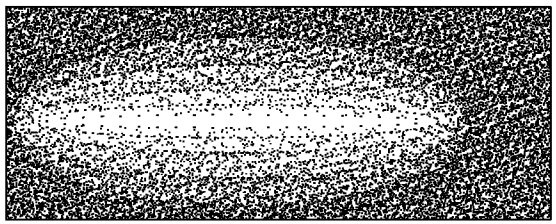
FIGS. 6*b* and 6*c* respectively illustrate the image of an x-ray beam respectively focused in one dimension and in two dimensions in accordance with the present invention.
Figure 6C:
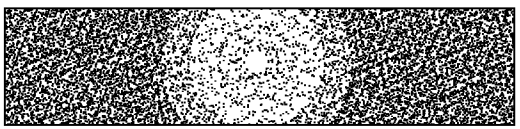

Referring to FIG. 6*a*, there is shown a compound continuously variable focal length lens 28 in accordance with another embodiment of the present invention. Continuously variable focal length lens 28 is adapted to receive an x-ray beam 30 and includes a first focusing portion in the form of a first beryllium material 32 having first and second spaced, cylindrical slots 32*a* and 32*b* therein. X-ray beam 30 passes through the first and second cylindrical slots 32*a* and 32*b* which focus the x-ray beam in a first dimension as shown by the horizontally elongated line in FIG. 6*b*. Continuously variable focal length lens 28 further includes a second focusing stage comprised of a second beryllium material 34 having first through sixth cylindrical slots 34*a*-34*f* disposed in a spaced manner within the material. The first and second cylindrical slots 32*a*, 32*b* within the first beryllium material are oriented at a right angle relative to the cylindrical slots 34*a*-34*f* within the second beryllium material 34. Thus, the first beryllium material 32 focuses the x-ray beam in a first direction (in this example vertically), while the second beryllium material 34 focuses the x-ray beam in a second direction transverse to the aforementioned first direction, i.e., horizontally. The result is the focusing of the beam in the form of a generally circular spot as shown in FIG. 6*c*. The dual focused x-ray beam is then directed onto a reflector 36 which reflects the focused electron beam to a camera 38 capable of providing the images shown in FIGS. 6*b* and 6*c*. Shown in FIG. 6*d* is the frequency spectrum of the incident x-ray beam 30.

Referring to FIG. 7*a*, there is shown a simplified schematic diagram of the manner in which the focal length of a continuously variable focal length lens 46 of the present invention is changed by rotation of the beryllium material 50 relative to the axis of an incident x-ray beam 48. X-ray beam 48 is directed onto a first surface of the beryllium material 50 and through the material so that the beam transits first and second cylindrical slots 50*a* and 50*b* within the material. The exiting x-ray beam is directed onto a reflector 54 which directs the beam to a camera 56 for recording a visual image of the x-ray spectrograph. FIG. 7*a* shows the beryllium material 50 rotated in the direction of arrow 52 to change the focal length of the lens. FIG. 7*b* is a graphic illustration of the change in the focus size in microns using the scaling factor of the present invention of $1/\cos(\phi)$, where $\phi$ is the angular rotation of the beryllium material relative to the axis of the incident x-ray beam 48. Shown in FIG. 7*b* are the changes in focal size for x-ray beams of 7.1 and 7.2 KeV which illustrates the variation of focus size with changes in incident x-ray beam energy. Using the aforementioned scaling factor, it can be determined that rotating the beryllium material through 45° has the equivalent effect on the change on the focal length of the lens of adding 1.4 refractive surfaces to the material.

Figure 8:
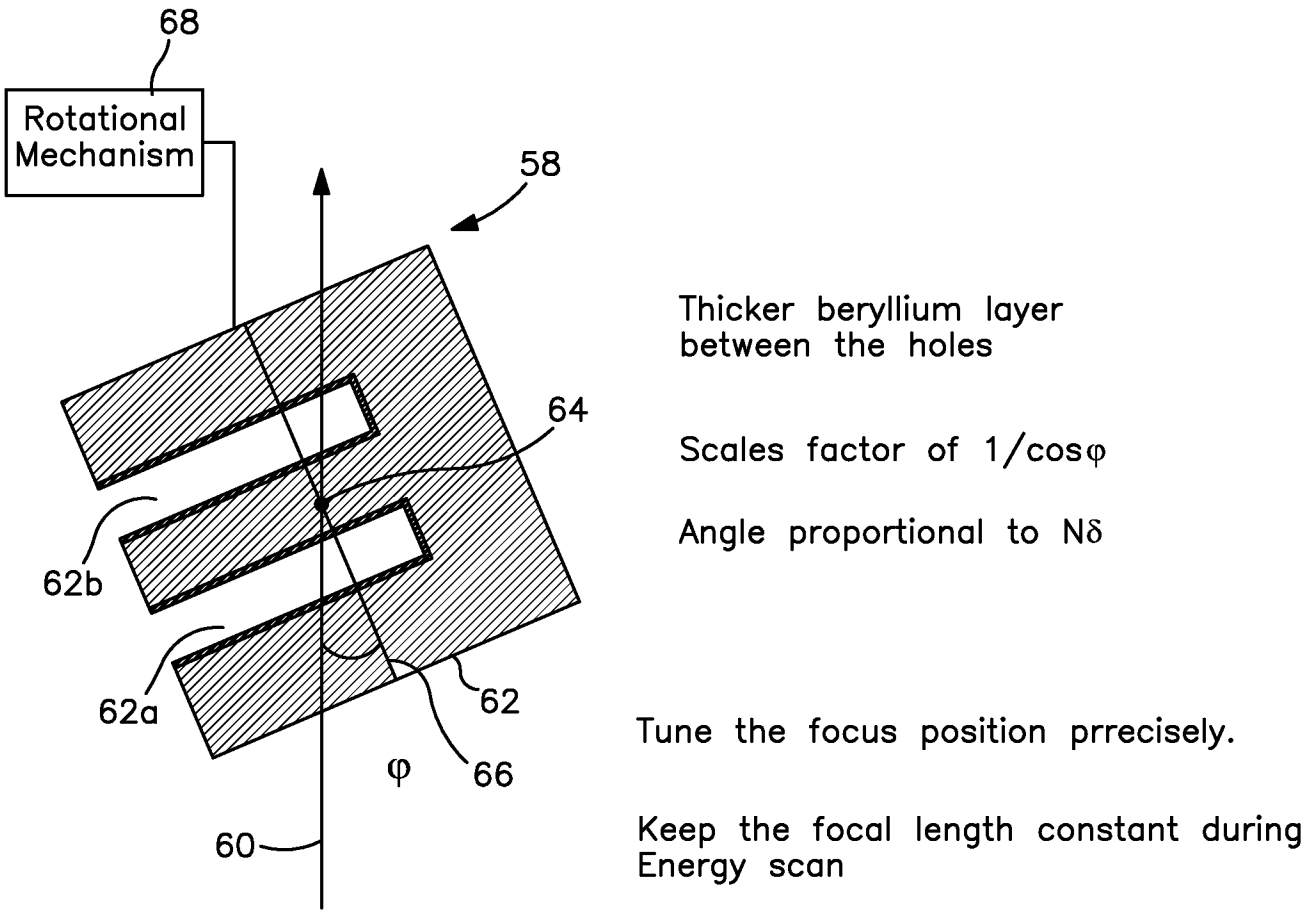
FIG. 8 is a simplified schematic diagram of a lens in accordance with the present invention.

Referring to FIG. 8, there is shown a simplified schematic diagram of a continuously variable focal length lens 58 in accordance with the present invention, where the beryllium material 62 is coupled to and rotated by a rotational mechanism 68. Rotational mechanism 68 may be conventional in design and operation and may include a stepper motor or a manually operated rotational displacement mechanism. The x-ray beam 60 is directed through the beryllium material 62 which includes first and second cylindrical slots 62*a* and 62*b* through which the x-ray beam passes. The axis of the crystal is represented as line 66 in FIG. 8, which shows the crystal having been rotated through an angle $\phi$ relative to the incident x-ray beam 60. Rotational mechanism 68 has rotated the beryllium material 62 about an axis 64 which is perpendicular to the axis of the x-ray beam and extends at a right angle to the plane of FIG. 8. A thicker layer of beryllium is disposed between the first and second cylindrical slots 62*a* and 62*b*. The scaling factor is $1/\cos(\phi)$, where the angle $\phi$ is proportional to $N\ \delta$ where N is the number of holes, and $\delta$ is the refractive index of the beryllium material. The scaling factor provides the change in path length of the x-ray beam through the material with an angular change in the orientation of the material. Rotational mechanism 68 allows for the precise tuning of the focus position of the beryllium material 62. By changing the focal position of the beryllium material 62 by rotating the material using rotational mechanism 68, the photon energy of the incident electron beam 62 may be scanned over a large frequency range while maintaining the focal point of the material fixed on a specimen being investigated to provide a spectrograph representing the properties and characteristics of the specimen material. Large changes on the material's focal length may be achieved by changing the number of refractive surfaces in or on the material, while smaller changes, i.e., fine tuning, may be accomplished by rotating the material. In addition, the small size of the continuously variable focal length lens of the present invention allows it to be located within a small vacuum chamber which eliminates atmospheric absorption of the x-rays for more accurate and predictable performance in focusing the x-ray beam.

While particular embodiments of the present invention have been described, it will be obvious to those skilled in the relevant arts that changes and modifications may be made without departing from the invention in its broader aspects. Therefore, the aim in the appended claims is to cover all such changes and modifications that fall within the true spirit and scope of the invention. The matters set forth in the foregoing description and accompanying drawings is offered by way of illustration only and not as a limitation. The actual scope of the invention is intended to be defined in the following claims when viewed in their proper perspective based on the prior art.

We claim:

1. A method for providing a continuously variable focal length for an x-ray beam comprising the steps of:

providing a material of low atomic number material, said material including a first and second optically matched concave surfaces having the same focal length in common alignment and disposed in a spaced manner from one another;

directing the x-ray beam onto the material through said first and second optically matched concave surfaces for focusing the x-ray beam at a focal point; and rotating said material about an axis generally perpendicular to the x-ray beam and to said first and second optically matched concave aligned surfaces where said rotation allows for fine tuning of the focal point by directly changing the location of the focal point of the x-ray beam in a continuous manner, as well as maintaining the focal point at a fixed location to compensate for wavelength dispersion.

2. The method of claim 1 further comprising the step of providing said first and second matched concave surfaces in common alignment and disposed respectively on said first and second opposed sides of said material in the form of first and second matched concave recesses through which the x-ray beam is directed.

3. The method of claim 2 further comprising the step of providing said material with a pair of third and fourth matched concave surfaces disposed within said material and aligned with said first and second matched concave recesses respectively disposed on said first and second opposed sides of said material through which the x-ray beam is passed.

4. The method of claim 3 further comprising the step of providing said material with plural pairs of matched concave surfaces disposed within said material and aligned with said first and second concave recesses and said third and fourth concave surfaces through which the x-ray beam is passed.

5. The method of claim 4 further comprising the step of decreasing the number of pairs of matched, aligned concave surfaces within said material for increasing the focal length of the material or increasing the number of pairs of matched, aligned concave surfaces within the material for decreasing the focal length of the crystal.

6. The method of claim 5 further comprising the step of providing said material with plural spaced curvilinear slots aligned with said first and second matched recesses respectively disposed in the first and second surfaces of the material, wherein opposed portions of each of said material slots form a respective pair of matched, aligned concave surfaces through which the x-ray beam is directed within said material.

7. The method of claim 1, wherein said material is comprised of beryllium or lithium, or other low Z material.

8. Apparatus for providing a continuously variable focal length for an x-ray beam, said apparatus comprising:

a first focusing material having a low atomic number and including a first and second optically matched aligned surfaces having the same focal length and disposed in spaced relation within said first focusing material, wherein the x-ray beam transits said first and second concave, matched, aligned surfaces; and a rotational drive coupled to said material for rotating said material about an axis generally perpendicular to the x-ray beam and to said first and second concave, matched aligned surfaces, wherein said material focuses the x-ray beam in a continuously variable manner with rotation of said material to continuously change a focal length associated with said apparatus.

9. The apparatus of claim 8, wherein said first focusing crystal is comprised of beryllium or lithium, or other low Z material.

10. The apparatus of claim 8, wherein said first focusing material includes first and second matched concave recesses respectively disposed in said first and second opposed sides of said material.

11. The apparatus of claim 10, wherein said first focusing material further includes a cylindrical slot therein having opposed portions forming third and fourth matched concave surfaces aligned with said first and second matched concave recesses for passing said x-ray beam.

12. The apparatus of claim 10, wherein said rotational drive includes a motor or a manually operating rotation mechanism.

13. The apparatus of claim 8, wherein said first focus lens focuses the x-ray beam in a first direction, said apparatus further comprising a second focusing material comprised of a low Z material and having plural concave, matched aligned surfaces having the same focal length and disposed in spaced relation in said material, wherein said second focusing material is aligned with said first focusing material so that the x-ray beam is directed onto said second focusing material and exits said second focusing material, and wherein the x-ray beam transits the plural concave, matched aligned surfaces on or in said second focusing material, and wherein said second focusing material focuses the x-ray beam in a second direction, wherein said first and second directions are orthogonal.

* * * * *